US006058669A

United States Patent [19]

Argay et al.

[11] Patent Number: 6,058,669

[45] Date of Patent: May 9, 2000

[54] JOINT OF CONCRETE BUILDING ELEMENTS

[75] Inventors: Ivan Argay; Vojtech Halik, both of Prague, Czech Rep.

[73] Assignee: Sicon, s.r.o., Czech Rep.

[21] Appl. No.: 08/945,181

[22] PCT Filed: Mar. 26, 1996

[86] PCT No.: PCT/CZ96/00009

§ 371 Date: Dec. 17, 1997

§ 102(e) Date: Dec. 17, 1997

[87] PCT Pub. No.: WO97/36067

PCT Pub. Date: Oct. 2, 1997

[51] Int. Cl.[7] ..... E04B 1/19

[52] U.S. Cl. ..... 52/251; 52/259; 52/236.8; 52/236.9; 52/285.4; 403/269; 403/265; 403/267

[58] Field of Search ..... 403/269, 265, 403/267; 52/236.8, 236.9, 285.4, 583.1, 251, 259

[56] References Cited

U.S. PATENT DOCUMENTS

| | | | |
|---|---|---|---|
| 938,458 | 11/1909 | Brockhausen | 52/285.4 |
| 961,682 | 6/1910 | Conzelman | 52/236.9 |
| 3,283,458 | 11/1966 | Gersovitz . | |
| 3,645,056 | 2/1972 | Gerola | 52/259 |
| 3,763,613 | 10/1973 | Wise . | |
| 3,834,095 | 9/1974 | Ohlson | 52/122 |
| 4,081,935 | 4/1978 | Wise | 52/236.8 |
| 4,167,840 | 9/1979 | Ivany | 52/438 |
| 4,363,200 | 12/1982 | Goldenberg | 52/251 |
| 4,443,985 | 4/1984 | Moreno | 52/236.8 |
| 4,863,305 | 9/1989 | Schold | 52/285.4 X |
| 5,466,086 | 11/1995 | Goto | 403/267 X |
| 5,809,712 | 9/1998 | Simanjuntak | 52/236.9 X |

FOREIGN PATENT DOCUMENTS

| | | |
|---|---|---|
| 0055666 | 7/1982 | European Pat. Off. . |
| 0150664 | 8/1985 | European Pat. Off. . |
| 0184995 | 6/1986 | European Pat. Off. . |
| 0318712 | 6/1989 | European Pat. Off. . |
| 0570717 | 11/1993 | European Pat. Off. . |
| 2456182 | 12/1980 | France . |
| 3417330 | 9/1985 | Germany . |
| 596399 | 3/1978 | Switzerland . |

*Primary Examiner*—Christopher T. Kent
*Assistant Examiner*—Phi Dieu Tran
*Attorney, Agent, or Firm*—Burns, Doane, Swecker & Mathis, LLP

[57] ABSTRACT

The joint of concrete building elements includes a system of connecting pins (2), formed by rows of mutually parallel bars, the central parts of which cross the area end sections, concreted in mutually joined building elements. The connecting pins (2) are arranged in a brush system in at least one row in particular, however, into a group of mutually parallel rows of the connecting pins (2) arranged one over the other. The system of connecting pins (2) is concreted, in part of its length, into the contact surfaces of the supporting column head (1), from which the protruding second sections of the length of connecting pins (2) are concreted in the ceiling structure, particularly in the ceiling slab (3) and/or in ceiling girders (4).

14 Claims, 1 Drawing Sheet

JOINT OF CONCRETE BUILDING ELEMENTS

FIELD OF THE ART

The invention relates to a joint of concrete building elements comprising, in the area of contact of concrete elements, shearing supporting parts for transfer of shearing forces.

STATE OF THE ART

When placing a horizontal ceiling structure onto point or linear supports, particularly supporting columns or supporting walls of a building structure, it is above all necessary to ensure a reliable transfer of shearing forces from a horizontal supporting structure into a vertical supporting structure of the column. The most popular resolution of this problem are beam ceiling structures, at which loads from a ceiling slab are transferred into ceilings beams or girders which have a sufficient cross sectional area to transfer shearing forces and which are, in addition, supported by an appropriate arrangement of shearing reinforcement in the form of bents of reinforcing bars and which are then mounted onto vertical supporting columns, in particular, by mounting ceiling beams directly onto heads of sectioned columns, brackets joined to heads of columns or into recesses formed in supporting columns. The disadvantages of such beam ceiling structures are well known and are due to the tall constructional height of the ceiling structure which diminishes the useful height of a building structure storey and causes further problems related to technological distribution and similar systems.

The disadvantage of the tall structural height of beam ceiling structures may be obviated by means of a flat-slab ceiling construction, where a ceiling slab is mounted on pyramid or truncated-conical shaped ceiling heads, the smaller base of which is connected to supporting columns heads and the bigger base of which forms a supporting surface for the ceiling slab mounting or part of the ceiling slab itself.

The Czech patent 144 928 has introduced a monolithic reinforced concrete ceiling, consisting of a monolithic reinforced concrete slab mounted on prefabricated column heads formed by truncated-conical or flat cylindrical heads the thickness of which basically corresponds with the thickness of the ceiling slab. The central part of the heads are joined to supporting columns heads and to increase their shearing bearing power, they are pre-stressed by means of a constructional arrangement whereby a circumferential cylindrical surface of heads is provided with a circumferential semi-groove in which a wrapped circumferential pre-stressed reinforcement is mounted, and under which radial bars which are fixed by wrapping are mounted to transfer shearing stresses.

A further improvement of this answer to a girderless ceiling structure consists of a monolithic ceiling slab around the ceiling head which is reinforced with a spiral reinforcement and which should ensure a perfect joint of the monolithic ceiling slab and of a prefabricated ceiling prestressed head, as well as transfer of shearing forces into the ceiling head. A disadvantage this solution is due to the complicated production process of pre-stressed ceiling heads, making them expensive and thus increasing the costs of ceiling structures.

Therefore, the invention aims to provide an answer to joining reinforced concrete structures and elements, particularly a horizontal ceiling structure, with vertical supporting elements where the transfer of shearing forces between both joined building elements and structures would be ensured by simple jointing means which are neither complicated nor expensive.

BACKGROUND OF THE INVENTION

This task has been resolved by a joint of concrete building elements according to the invention, the principle of which consists in the fact that shearing supporting parts constitute a brush system of connecting pins, formed by several rows of mutually parallel bars; their central part crosses the area of contact of joined building elements and both end sections are concreted in the mutually joined building elements.

In an advantageous embodiment of the joint according to the invention, the radial connecting pins in a brush system are arranged in at least one horizontal row, particularly in a group of mutually parallel rows of connecting pins one above the other. The brush system of connecting pins are anchored in joined building elements at an acute angle of 30° to 60° with the vertical plane.

In another advantageous embodiment of the joint according to the invention, a part of the system of connecting pins is concreted in surfaces of contact in the head of the supporting column, from which the other sections of the length of the connecting pins are concreted in the ceiling structure, especially in a ceiling slab and/or in ceiling girders.

In another advantageous embodiment of the invention, the supporting column, in its area of contact, is provided with a circumferential rim in the form of a circumferential recess in the supporting collar of a depth of 10 mm to 40 mm, and of a height which corresponds with the thickness of the adjoining ceiling structure; the systems of connecting pins protrude from the bottom of the circumferential rim of the supporting column.

During the manufacture of the column, which is a part of the joint according to the invention, it is convenient to prefabricate the brush system of connecting pins which are formed by steel assembly plates concreted into the bottom of the circumferential rim of the supporting column and having a system of holes through which the connecting pins, joined to steel plates pass and one part of the length of which are concreted into the supporting columns. In an advantageous embodiment of the invention, the connecting pins are formed of parts of steel ropes separated by burning.

In an alternative advantageous embodiment of the joint according to the invention, the connecting pins, arranged in the radial brush system and protruding from the supporting column, are inserted in the brush system of connecting pins protruding from the joined areas of contact of the ceiling structure.

The joint for concrete building elements according to the invention may be used for joining and contacting any building elements, parts and structures, where it is necessary to ensure a transfer of shearing forces. Its advantages are most evident in joints of a supporting column to a ceiling slab, where such a joint consists of a simpler, cheaper and less complicated mounting of a thin ceiling slab onto a point support and where sufficient measures have been taken to prevent the column punching of slab.

LIST OF DRAWINGS

The invention will be described in more detail by means of embodiments of the joint for two parts of a building structure, illustrated in drawings, where:

PREFERRED EMBODIMENTS OF THE INVENTION

Figure 1:
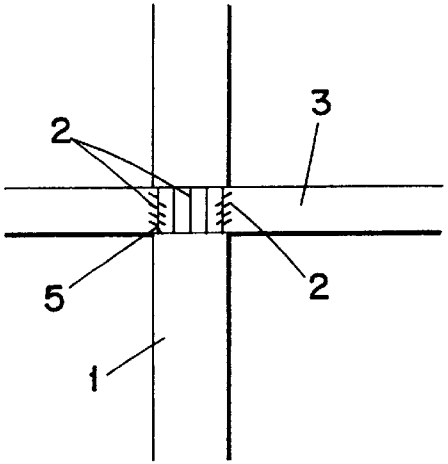
FIG. 1 shows a vertical section of a joint of a vertical prefabricated column to a monolithic reinforced concrete ceiling slab.
Figure 2:
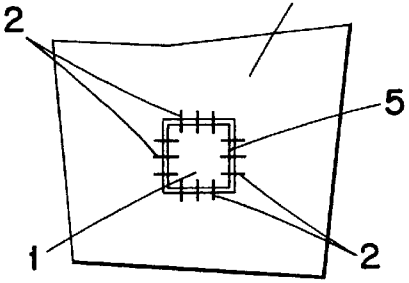
FIG. 2 shows a horizontal section of a joint of a vertical prefabricated column to a cut-out of a monolithic reinforced concrete ceiling slab.

In the first example of the embodiment of the joint of two parts of a building structure according to the invention, one of the parts being joined is a supporting column 1 and the other part being joined is a monolithic ceiling slab 3. In the joint, it is necessary to transfer shearing forces from the ceiling slab 3 to the supporting column 1. FIGS. 1 and 2 show the area of a supporting column joint, in this example, in the form of a prefabricated element passing through a reinforced concrete monolithic ceiling slab 3 with an even surface thickness of 10–20 cm. Only a small shearing surface is available for the transfer of shearing forces from monolithic ceiling slab 3 at the point of contact with supporting column 1, so that to allow a transfer of the shearing forces, there must be a special constructional adaptation in the joint area to prevent ceiling slab 3 being pierced by supporting column 1 due to its own weight and of useful loading from the ceiling structure.

This constructional adaptation consists of the supporting column 1, in this example a passing prefabricated column, being provided, at the level where it joins the ceiling slab 3 and in the area of its circumferential surfaces of contact, with a group of radial brush connecting pins 2, which are set in concrete up to half their length in the supporting column 1 while the remaining length protrudes radially and obliquely upwards from the circumferential surfaces of contact of the supporting column 1 and crosses the shearing gap at the point where ceiling slab 3 joins supporting column 1. In this example of the invention, each system of brush connecting pins 2, arranged on each side wall of supporting column 1, is formed by six horizontal rows of connecting pins 2 arranged one above the other; each row comprises five connecting pins 2. The connecting pins 2 are conveniently made e.g. of pieces of pull-rods, or cuttings from reinforcing bars. Each of the connecting pins forms an angle of 45° and is placed in a vertical plane parallel to the respective side wall of the supporting column 1 having a rectangular cross section.

In order further to improve transfer of shearing forces from the ceiling structure into the supporting column 1, the supporting column 1 has, in the area of the joint, a circumferential rim 5 formed by a circumferential recess in the circumferential surfaces of the supporting column 1 about 30 mm deep with a height corresponding with the thickness of the ceiling slab 3 of the ceiling structure.

During the manufacture of this joint in accordance with the invention, the prefabricated passing supporting columns 1 are fitted with the concreted systems of connecting pins 2 and form a casing of the lower surface of the concrete supporting slab of the ceiling slab 3 at the level of the lower edge of the circumferential rim 5. This casing is then mounted with and joined to the reinforced ceiling slab 3 which is adapted in the supporting column 1 area by the dimensions of reinforcing bars and arrangement thereof in order to work together with the systems of connecting pins 2 and to transfer shearing forces onto the connecting pins 2 and to the circumferential rim 5 area of the supporting column 1; whereupon the reinforced concrete ceiling slab 3 should be concreted—the protruding ends of the connecting pins systems 2 are then run into this ceiling slab upon completion of concreting. The connecting pins 2 are easily held in the desired position during manufacture of the prefabricated supporting column 1, because it is sufficient to mount the casing board, which forms the bottom of the circumferential rim 5, with a system of oblique holes, whose displacement and incline of axes correspond with the displacement and position of the connecting pins 2 in the brush system. An alternative embodiment of the casing board which remains part of the joint is described in further detail in the clarification of the example of the embodiment in FIG. 5.

Figure 3:
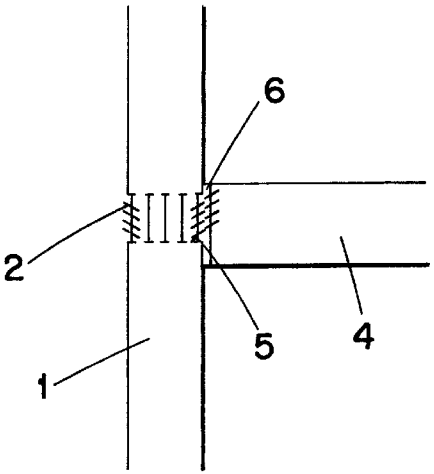
FIG. 3 shows a vertical section of a joint of a vertical supporting column to a horizontal ceiling girder.
Figure 4:
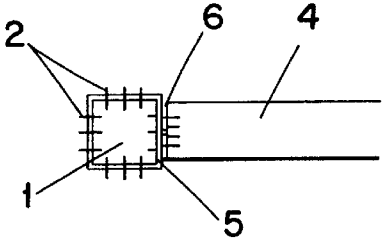
FIG. 4 shows a horizontal section of a joint of a vertical supporting column to a ceiling beam or girder.

The joint according to the invention may be used for various kinds of joined structures, particularly vertical supporting structures with horizontal supporting structures, e.g. it may be applied to a joint of the supporting column 1 with the ceiling girder 4, or with a beam in a monolithic or prefabricate embodiment, as it is shown in FIGS. 3. and 4. In this example of the embodiment, the vertical prefabricated passing supporting column 1 is of the same embodiment as the supporting column 1 shown in FIGS. 1. and 2. and by means of the joint according to the invention it is joined, in this example of the embodiment, to the prefabricated ceiling girder 4 from the face of which a similar brush system of connected pins protrudes, i.e., the system comprises thirty connecting pins 2 arranged in six rows, one above the other and with five connecting pins 4 in every row: these connecting pins 2 are arranged parallel to the connecting pins 2 which protrude from the supporting column 1, i.e. so that they protrude from the face of the ceiling girder 4—obliquely downwards, and they are mounted among the connecting pins 2 protruding from the side walls of the supporting column 1.

Upon the prefabricated ceiling girder 4 being mounted to the supporting column 1 which has, in this example of the embodiment, a circumferential rim 5, the space between the face of the ceiling girder 4 and walls of the circumferential rim 5 is filled with grout 6.

Figure 5:
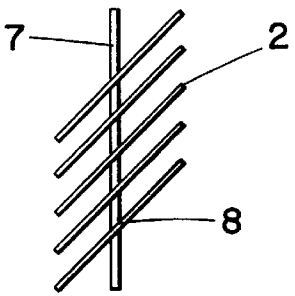
FIG. 5 shows a side view to a prefabricated system of connecting pins, fixed onto a common steel plate.

The concreting of connecting pins 2 into prefabricated supporting columns 1 or ceiling girders 4 is considerably facilitated by an assembly plate 7 shown in FIG. 5, and formed by a rectangular steel plate with a system of oblique holes 8 the axes of which incline with respect to the assembly plate 7 at the same angle as that at which the connecting pins 2 are to be mounted. The connecting pins 2 are inserted into the oblique holes 8 in such a way that their centre passes through the holes 8 and each half is directed outwards from the assembly plate 7. The centre part of the connecting pins 2 may be fixed in the holes 8 e.g. by welding, whereupon the assembly plate 7 may be mounted into the casing of the supporting column 1 so that it forms the bottom of the circumferential rim 5 of the supporting column 1, the casing, including the required number of assembly plates 7 keeping the connecting pins 2 in the desired positions during concreting, may then be grouted with a concrete mix.

The joint according to the invention may be applied in many other specific instances involving a joint of, in particular, prefabricated construction elements to a monolithic structure or to other prefabricated construction elements, if the requirement is to ensure a reliable transfer of shearing forces at the point of the joint. For instance, by use of connecting pins, arranged in brush systems, it is possible to joint a concrete wall to a ceiling slab, or to another ceiling structure where connecting pins protrude from the wall along its whole upper joining section, or may be used for a shearing joint of two parallel wall elements and so on.

We claim:

1. A joint of concrete building elements in particular for transferring of shearing forces, comprising:

a plurality of substantially parallel connecting pins passing through contact areas of the joined building elements, the plurality of connecting pins are secured in one of the joined building elements and extend into a single recess in said one of the joined building elements, and the connecting pins being inclined with respect to these joined building elements and forming acute angles directed in the opposite direction of the resultant shearing component of the forces for which the joint has been designed.

2. The joint according to claim 1, wherein the connecting pins are parallel to one another.

3. The joint according to claim 1, wherein the size of the acute angle is 30° to 60°.

4. The joint according to claim 1, wherein the connecting pins are arranged in at least one horizontal row or at least one vertical row.

5. The joint according to claim 1, wherein the connecting pins are concreted for some of their length into the contact areas of the head of a supporting column protruding from which are other sections of the length of the connecting pins concreted into a ceiling structure.

6. The joint according to claim 5, wherein the supporting column is provided with a circumferential rim in the form of a circumferential recess of the supporting column having a depth of 10 to 40 mm and a height corresponding with a thickness of the ceiling structure, so that the plurality of connecting pins protrude from a bottom of the circumferential recess of the supporting column.

7. The joint according to claim 6 wherein the bottom of the circumferential recess is formed by steel assembly plates concreted into the recess section and provided with a plurality of oblique holes passing through which are the connecting pins which are fixed to steel assembly plates.

8. The joint according to claim 5, wherein the ceiling structure is a ceiling slab or ceiling girders.

9. A joint of concrete building elements comprising:

a column having a single recess formed on at least one side of the column;

a plurality of connecting pins positioned in the recess and concreted into the column, the connecting pins arranged substantially parallel to one another and forming acute angles with the column directed in the opposite direction of a resultant shearing component of forces for which the joint has been designed; and a building element connected to the Column at the recess by the plurality of connecting pins.

10. The joint according to claim 9, wherein the acute angles are about 30° to about 60°.

11. The joint according to claim 9, wherein the building element is a ceiling structure.

12. The joint according to claim 9, wherein the recess extends around a complete circumference of the column.

13. The joint according to claim 12, further comprising a plate positioned in a bottom of the recess and having angled holes receiving the plurality of connecting pins.

14. The joint according to claim 9, further comprising a plate positioned in a bottom of the recess and having angled holes receiving the plurality of connecting pins.

* * * * *